US007356155B2

(12) United States Patent
Monnie et al.

(10) Patent No.: US 7,356,155 B2
(45) Date of Patent: Apr. 8, 2008

(54) DEVICE AND METHOD FOR ASSISTING VOCALISTS IN HEARING THEIR VOCAL SOUNDS

(75) Inventors: Darrell James Monnie, Dundee, IL (US); Kathi Ruth Evans Lind, Elgin, IL (US); Patrick Christopher Scully, East Dundee, IL (US)

(73) Assignee: Lazarus Technologies, Inc., Elgin, IL (US)

( * ) Notice: Subject to any disclaimer, the term of this patent is extended or adjusted under 35 U.S.C. 154(b) by 350 days.

(21) Appl. No.: 10/623,267

(22) Filed: Jul. 18, 2003

(65) Prior Publication Data

US 2005/0013458 A1 Jan. 20, 2005

(51) Int. Cl.
*H04R 25/00* (2006.01)

(52) U.S. Cl. ..... 381/338; 381/337; 381/370

(58) Field of Classification Search ..... 381/374, 381/376, 377–379, 338, 339, 344, 352, 341, 381/160, 366, 367, 370, 371, 373, 375, 382, 381/381, 372; 181/128, 129, 136, 127, 126, 181/133, 20–22, 35, 600, 28, 377–379, 381, 181/18; 379/430, 449

See application file for complete search history.

(56) References Cited

U.S. PATENT DOCUMENTS

| | | | | |
|---|---|---|---|---|
| 738,593 | A * | 9/1903 | Atkinson | 181/128 |
| 2,481,387 | A * | 9/1949 | Bonecutter | 379/446 |
| 2,998,497 | A * | 8/1961 | May | 379/449 |
| 3,182,746 | A * | 5/1965 | Schaefer, II | 181/20 |
| 4,881,256 | A * | 11/1989 | Malekos | 379/449 |
| 4,930,148 | A * | 5/1990 | Lee | 455/575.2 |
| 5,407,113 | A * | 4/1995 | Golliher | 224/181 |
| 6,130,953 | A * | 10/2000 | Wilton et al. | 381/375 |
| 6,229,901 | B1 * | 5/2001 | Mickelson et al. | 381/371 |
| D445,105 | S * | 7/2001 | Brinson | D14/187 |
| 2002/0067836 | A1 | 6/2002 | Paranjpe | |
| 2002/0131616 | A1 * | 9/2002 | Bronnikov et al. | 381/370 |
| 2002/0189894 | A1 * | 12/2002 | Davis et al. | 181/128 |

* cited by examiner

*Primary Examiner*—Huyen Le
(74) *Attorney, Agent, or Firm*—Bell, Boyd & Lloyd

(57) ABSTRACT

The present invention, in one embodiment, includes a reverb device and method for assisting vocalists in hearing their vocal sounds. The reverb device includes a vocal sound receiver, a sound director coupled to the vocal sound receiver and an ear sound deliverer coupled to the sound director. In addition to aiding users in hearing their own voices, the present invention facilitates vocal training, enjoyment and entertainment for users.

35 Claims, 7 Drawing Sheets

DEVICE AND METHOD FOR ASSISTING VOCALISTS IN HEARING THEIR VOCAL SOUNDS

BACKGROUND OF THE INVENTION

It is well known that singers, speakers and other vocalists rely on their ability to hear themselves in order to make their desired vocal sounds. The return of one's vocal sounds to one's own ears, often described as reverberation or reverb, can play a significant role in a vocalist's ability to control vocal content, quality, pitch and other vocal sound characteristics. In addition, reverb is known to be a reassuring factor for vocalists.

People often find it easier to sing and speak in environments which facilitate reverb. This is one reason why many people like to sing in the bathroom. However, relying on a special room for reverb has several disadvantages. The quality of the reverb can be relatively low. This is because the vocal sound is affected by the walls and other items in the room before reaching the vocalist's ears. Also, it can be relatively inconvenient for vocalists to have to visit special rooms or facilities every time they want to hear reverb.

Certain electronic sound systems have been developed to provide reverb to singers. In the recording industry, singers often wear electronic headphones when they make recordings in a studio. When the singers sing into the microphone, the sound system records the voice and, at the same time, electronically transmits the voice to the headphones. This type of sound system includes an array of interconnected electronic components and hardware.

This sound system has several disadvantages. The sound system is not portable due to its reliance on electrical power and its relatively large size and weight and its wiring configuration. Also, it is relatively inconvenient and expensive for users to maintain and operate the sound system.

Consequently, neither this sound system or the bathroom-type reverb environment assist vocalists in hearing themselves in a relatively convenient fashion in various locations, such as, at home, in an automobile or outside.

Therefore, there is a need to overcome the disadvantages described above.

SUMMARY OF THE INVENTION

The present invention relates to a device and method for assisting vocalists in hearing their own vocal sounds. In particular, the present invention relates to a voice feedback or reverb device worn on the head of a user for acoustic monitoring of the user's own vocal delivery. In one embodiment, the reverb device is entirely mechanical and includes no electrical components or circuitry. The reverb device includes: (a) a vocal sound receiver which receives the vocal sounds coming from the user's mouth and/or nose; (b) a sound director, coupled to the vocal sound receiver, which directs the vocal sounds toward the user's ear; (c) an ear sound deliverer which outputs the vocal sound to the user's ear; and (d) a head securing member, such as a head band or strap, which secures the vocal sound receiver, sound director and ear sound deliverer to the user's head.

In one embodiment, the vocal sound receiver, sound director and ear sound deliverer are regions of a one-piece substantially tubular-shaped unit, and this unit is preferably made of a relatively light weight plastic. The relatively light weight and integral structure of this embodiment facilitates the portability of the reverb device. In addition, the relatively light weight of this embodiment prevents or reduces possible fatigue effects caused by wearing the reverb device.

The reverb device, in one embodiment, includes a sound regulator which enables users to regulate certain characteristics of the vocal sounds produced by the user. For example, the sound regulator can enable the user to adjust the volume of the vocal sounds transmitted to the user's ear.

In one embodiment, the reverb device includes a length adjuster which enables users to adjust the overall length of the reverb device. As such, users of different ages and sizes can adjust the reverb device to properly fit on their heads.

The reverb device, in one embodiment of the present invention, includes a mechanical, non-electronic tubular member having a vocal sound receiver, a sound director and an ear sound deliverer. When attached to the user's head with a head securing member, the reverb device facilitates the flow of vocal sounds from the user to the user's ear. In this embodiment, the reverb device is relatively light weight and integral, and therefore, has a relatively high degree of portability. This type of reverb device can serve as a vocal training tool for professional, amateur and student vocalists, and this reverb device can also serve as an entertainment device or toy for people who enjoy hearing themselves sing or speak.

It is therefore an advantage of the present invention to provide a device and method for assisting vocalists in hearing their vocal sounds.

Another advantage of the present invention is to enhance voice feedback to vocalists.

Yet another advantage of the present invention is to provide vocalists with a portable device for hearing reverb during their vocal delivery.

Still another advantage of the present invention is to increase the convenience for a vocalist in hearing his/her vocal sounds during vocal delivery.

Another advantage of the present invention is to decrease the expense associated with hearing reverb during vocal delivery.

Yet another advantage of the present invention is to provide a method for obtaining reverb which does not require a vocalist to visit a special room or facility which is specially adapted as a reverb environment.

Additional features and advantages of the present invention are described in, and will be apparent from, the following Detailed Description of the Invention and the figures.

DETAILED DESCRIPTION OF THE INVENTION

Figure 1:
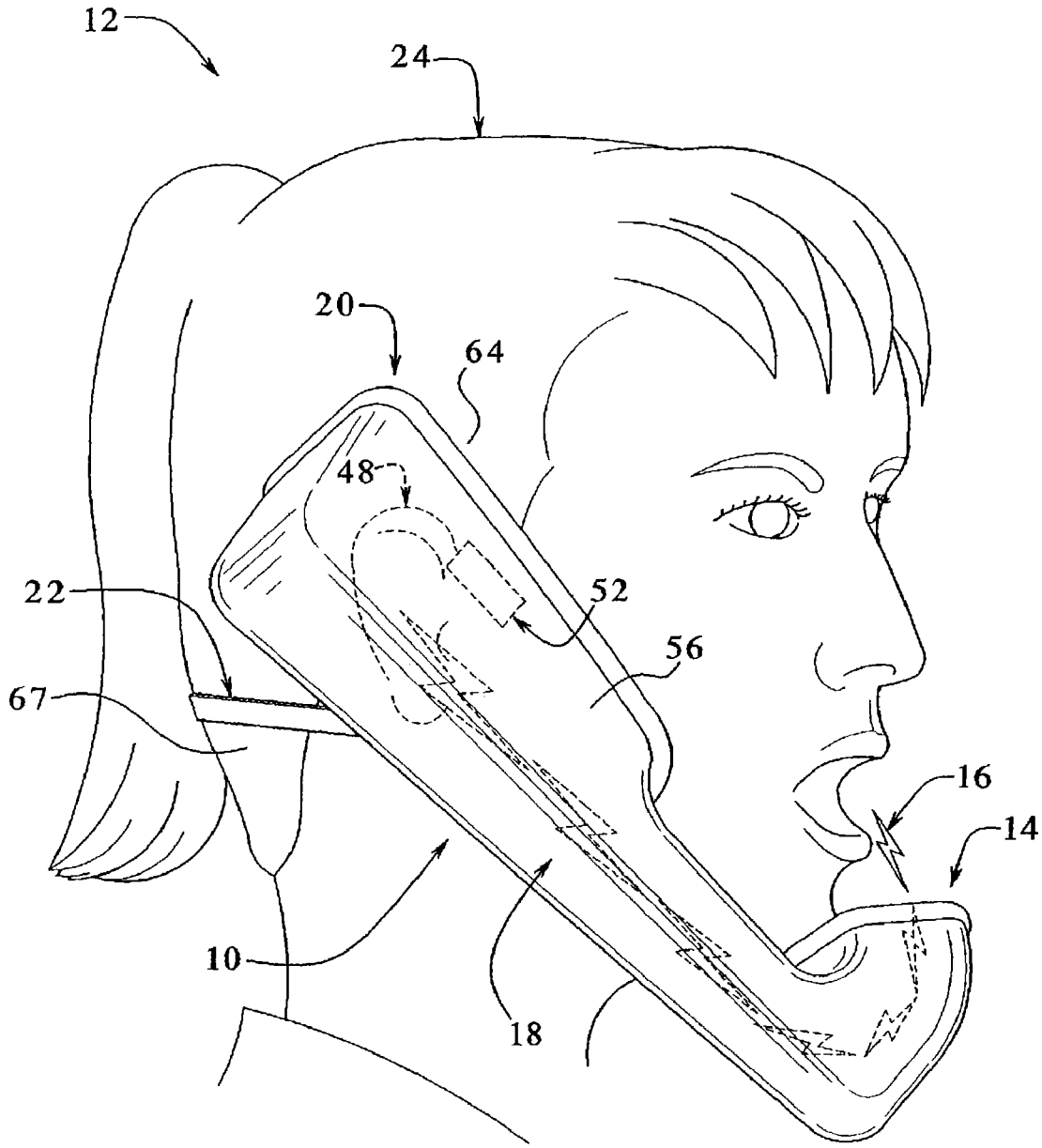
FIG. 1 is an elevated right side perspective view of the reverb device worn on the right ear of a user in one embodiment of the present invention.

Referring to FIGS. 1 through 8, the present invention includes a reverb head set, reverb head gear apparatus or reverb device 10 which assists a user 12 in hearing his/her own voice. In one embodiment, the reverb device 10 includes: (a) a vocal sound receiver 14 which receives vocal sounds 16 from the user 12; (b) a sound director 18 which directs the transmission of the sound 16 to the ear input member or ear sound deliverer 20; and (c) a head securing member 22 which secures the reverb device 10 to the head 24 of the user 12.

I. Vocal Sound Receiver

Figure 2:
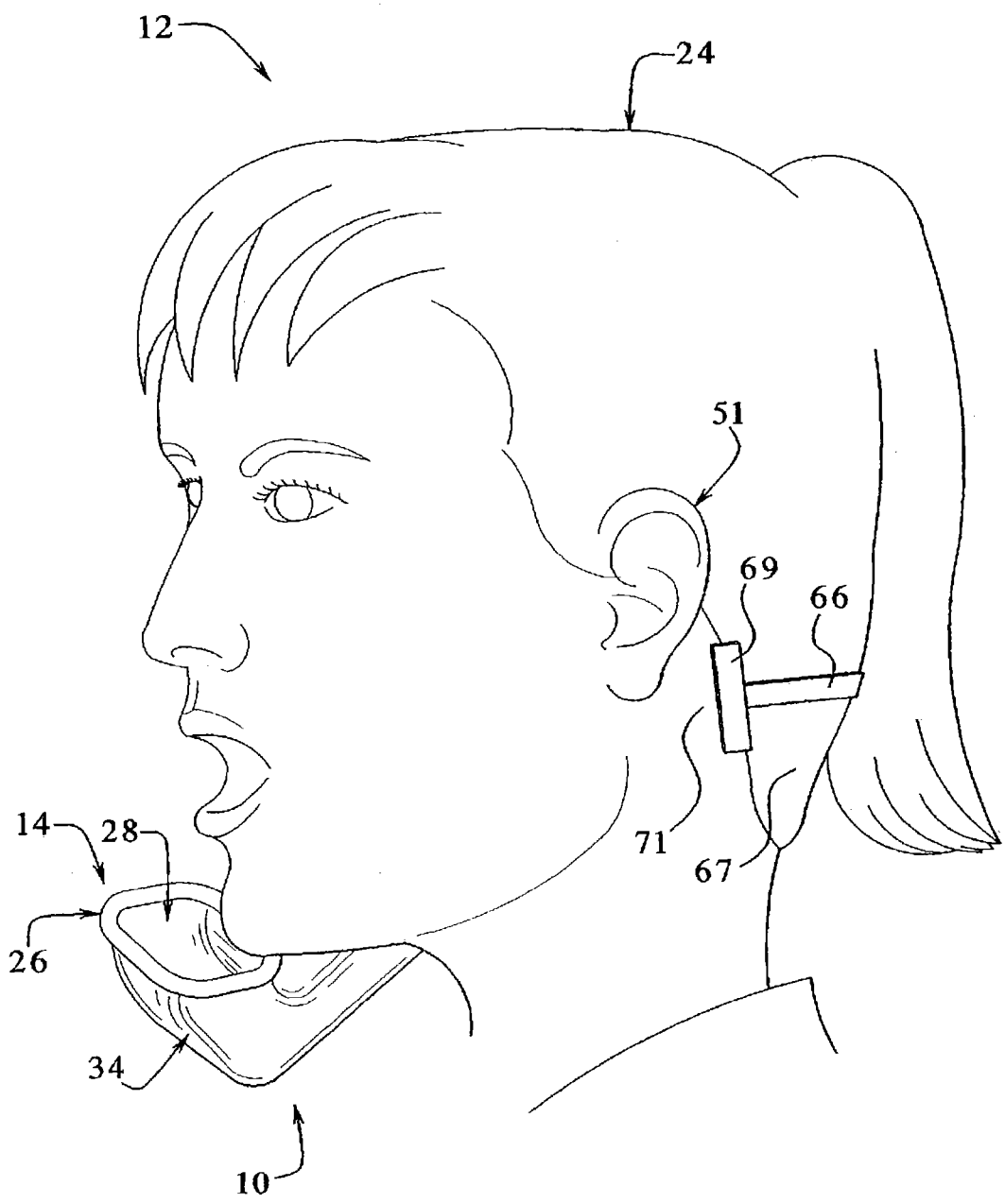
FIG. 2 is an elevated left side perspective view of the reverb device worn on the right ear of a user in one embodiment of the present invention.
Figure 3:
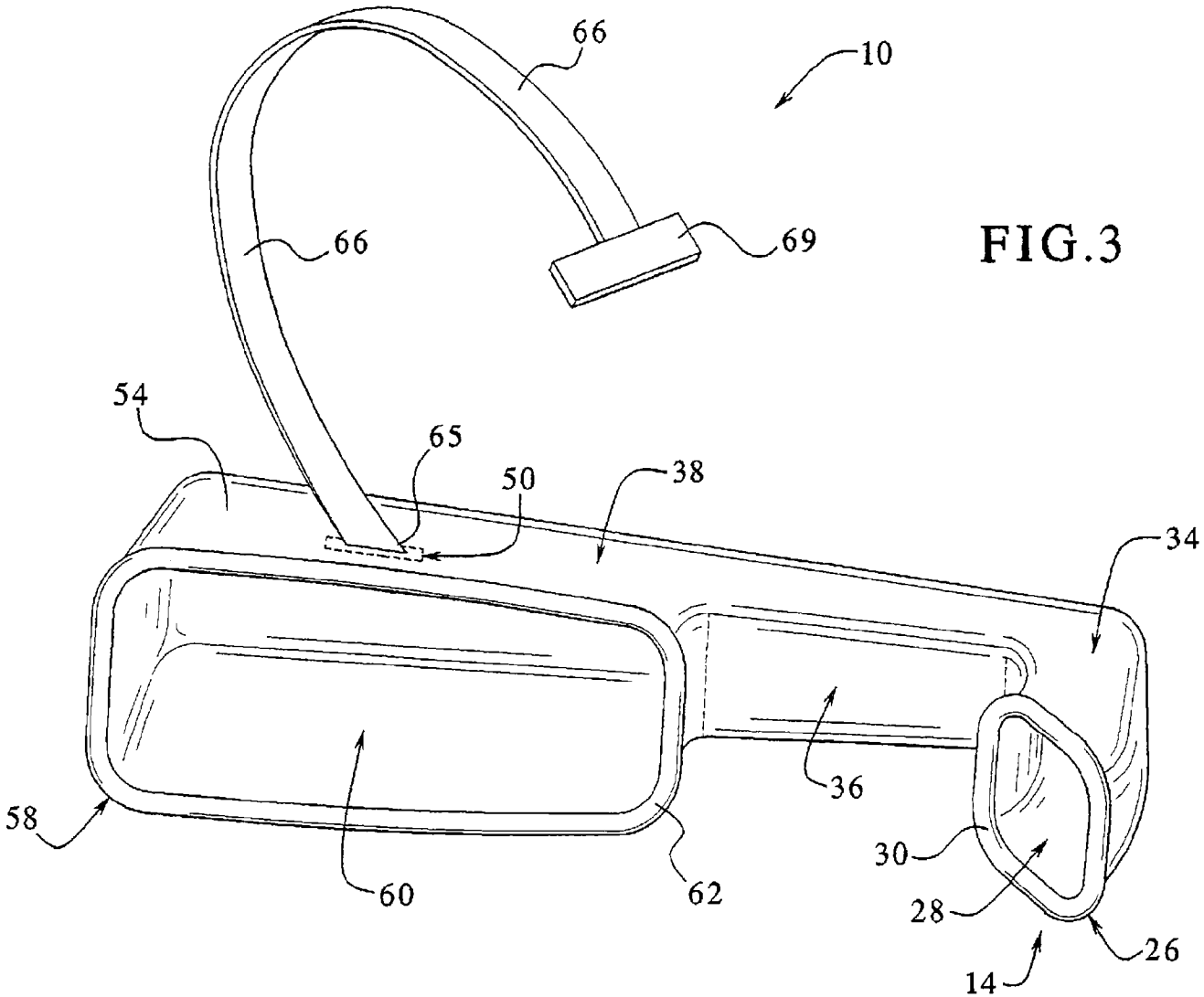
FIG. 3 is an elevated interior side perspective view of the reverb device in one embodiment of the present invention.

As best illustrated in FIG. 3, the vocal sound receiver 14 preferably includes an opening wall 26 which defines an opening 28 for receiving vocal sounds 16. In addition, the vocal sound receiver 14 preferably includes a guard member 30 attached to the opening wall 26. The guard member 30 can prevent or reduce discomfort or injury to the user if the user's face or lips come into contact with the opening wall 26. It is preferable that the guard member 30 includes a cushioning or biasing member which is relatively soft and resilient, including, without limitation, a member constructed of a suitable rubber, foam or plastic material. In the embodiment illustrated in FIGS. 1 through 5, the guard member 30 is a separate component connected to the opening wall 26. However, it should be appreciated that in other embodiments not illustrated, the guard member 30 can be integral with the opening wall 26.

Figure 6:
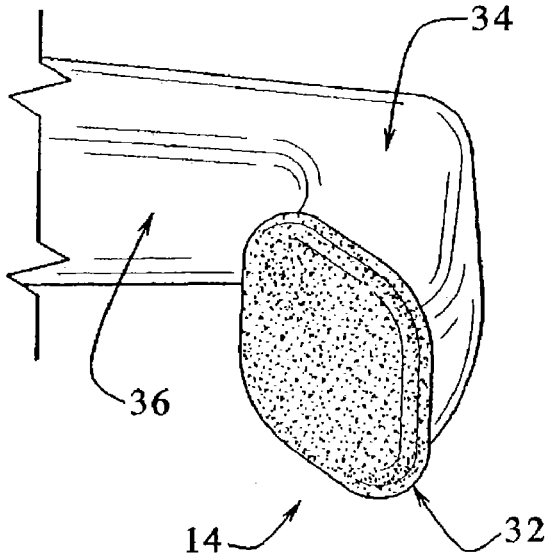
FIG. 6 is an elevated interior side perspective view of a portion of the reverb device illustrating the cover over the vocal sound receiver in one embodiment of the present invention.

Referring to FIG. 6, in one embodiment, the vocal sound receiver 14 includes a cover 32 which is attached to the opening wall 26. The cover 32 includes at least one, and preferably a plurality of openings or orifices illustrated by the dots on the cover 32 shown in FIG. 6. The cover 32 can have a porous structure, a sponge-like structure or a filter structure which permits the transmission of sound 16 through the cover 32. In one embodiment, the cover 32 functions as a sound modifier or sound filter which affects the characteristics of the vocal sound 16 which are ultimately transmitted to the ear sound deliverer 20. In another embodiment, the cover 32 functions as a debris and/or saliva filter which filters out saliva and/or debris which may be directed into the vocal sound receiver 14 during use of the reverb device 10. Depending upon the particular embodiment, the cover 32 may be removable, disposable and/or washable, or the cover 32 may be non-removably connected to the opening wall 26.

II. Sound Director

Figure 4:
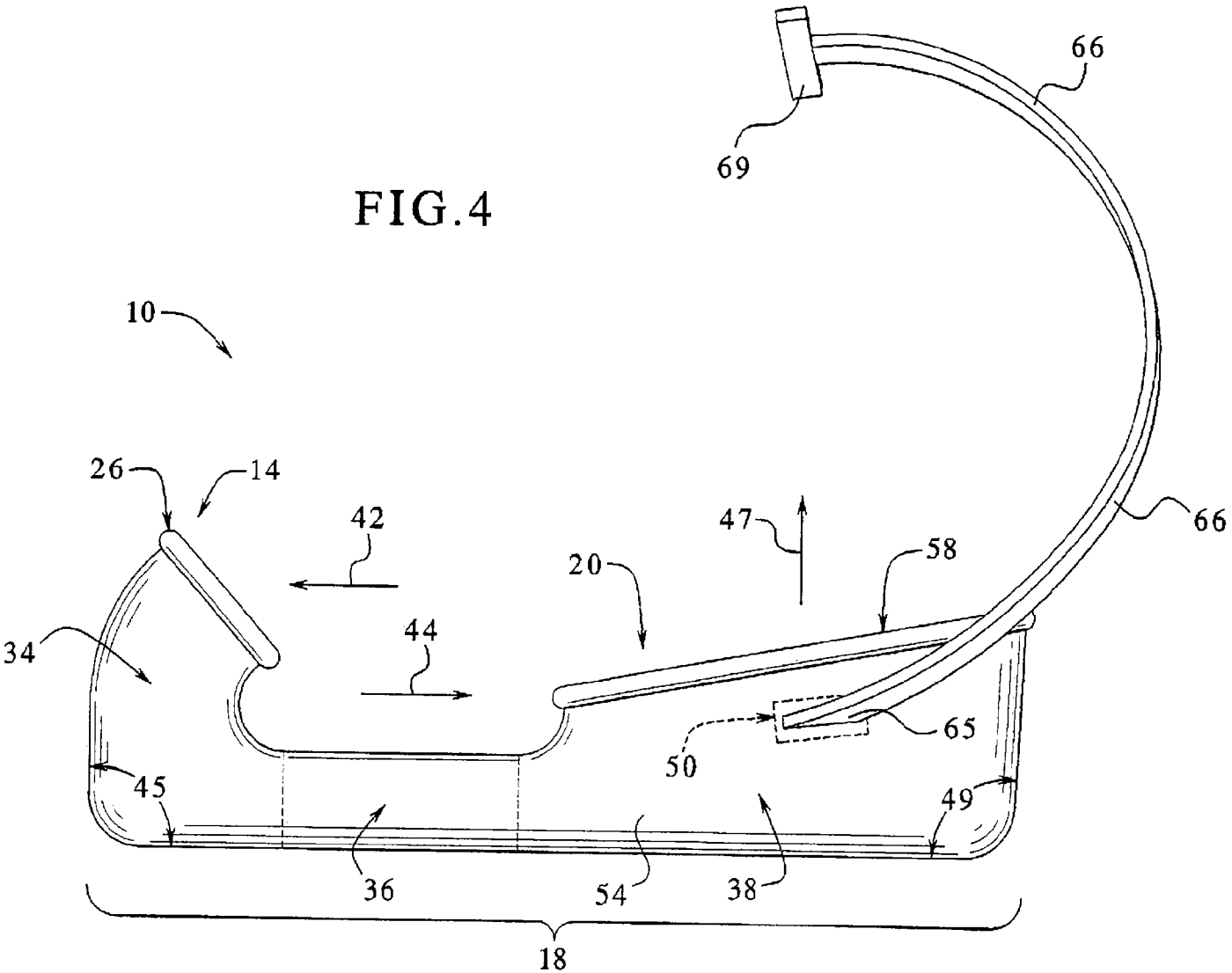
FIG. 4 is a bottom view of the reverb device in one embodiment of the present invention.
Figure 5:
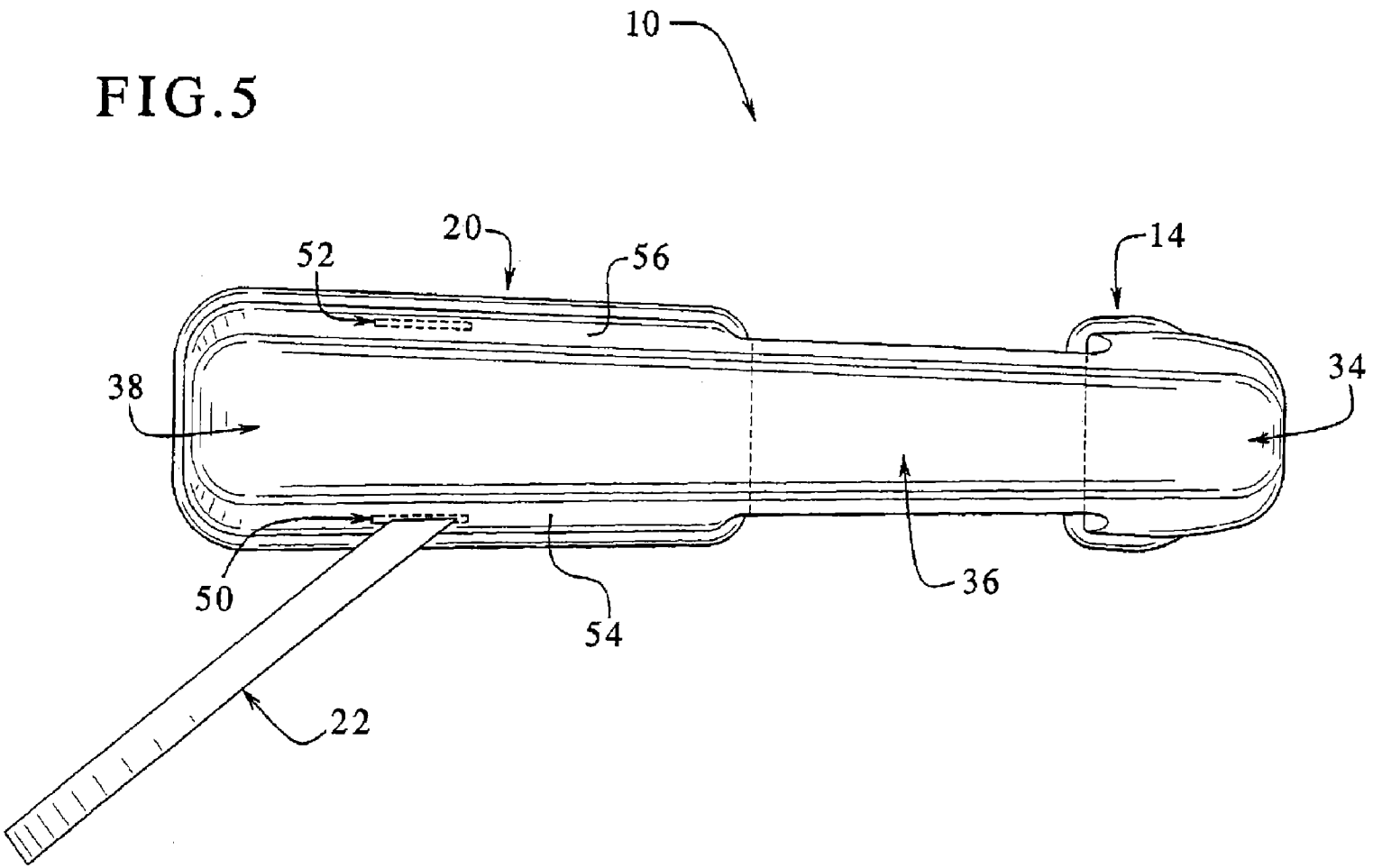
FIG. 5 is a side elevated view of the rear portion of the reverb device in one embodiment of the present invention.

As best illustrated in FIG. 4, in one embodiment, the sound director 18 of the reverb device 10 includes: (a) a curved tubular portion 34 coupled to the vocal sound receiver 14; (b) an intermediate tubular portion 36 coupled to the curved tubular portion 34; and (c) a curved tubular portion 38 coupled to both intermediate tubular portion 36 and the ear sound deliverer 20. In the embodiment illustrated in the FIGS. 1 through 6, the sound director 18 is a U-shaped, one-piece member wherein the tubular portions 34, 36 and 38 are integrally connected. It should be appreciated, however, that in other embodiments, the tubular portions 34, 36 and 38 can be separate components which are coupled or connected to one another in any suitable fashion.

The curved tubular portion 34 defines a bend 40 which redirects the vocal sound 16 from a direction 42 aimed in front of the user 12 to a direction 44 aimed to the back of the user 12. The bend 40 is preferably defined by an angle 45 of approximately ninety degrees.

The intermediate tubular portion 36 guides and directs the vocal sound 16 to the ear sound deliverer 20. Preferably, the intermediate tubular portion 36 is substantially straight. However, it should be appreciated that the intermediate tubular portion 36 can have any other suitable geometry or configuration in order to produce a desired effect on the transmission of the vocal sounds 16.

The curved tubular portion 38 defines a bend 46 which redirects the vocal sound 16 from the back direction 44 to a direction 47 aimed toward the ear 48. The direction 47 is preferably substantially perpendicular to the direction 44. The bend 46 is preferably defined by an angle 49 of approximately ninety degrees.

In addition, the curved tubular portion 38 preferably includes a plurality of fasteners or mounting areas 50 and 52 connected to the sides 54 and 56, respectively. The fasteners or mounting areas 50 and 52 enable the user 12 to removably attach the head securing member 22 to the sides 54 and 56 of the curved tubular portion 38. Accordingly, if the user 12 desires to install the reverb device 10 on the right ear 48, the user 12 attaches the head securing member 22 to the fastener or mounting area 50 on side 54 of the curved tubular portion 38. Alternatively, the user 12 can install the reverb device 10 on the left ear 51 of the user 12 by attaching the head securing member 22 to the fastener or mounting area 52 on the side 56 of the curved tubular portion 38. In this manner, the reverb device 10 is interchangeable between a right ear orientation and a left ear orientation. As described below, it should be appreciated that the reverb device 10 can include any suitable fastener or mounting area for the head securing member 22. Depending upon the particular embodiment, the fastener or mounting area can have any suitable location on the reverb device 10.

III. Ear Sound Deliverer

Referring to FIGS. 3 and 4, in one embodiment, the ear sound deliverer 20 includes an opening wall 58 which defines an opening 60 for delivering or outputting the vocal sound 16 to the ear 48. It is preferable that the ear sound deliverer 20 includes a head engagement member 62 which makes contact with a head portion 64 of the user. Head portion 64 is preferably defined by a perimeter surrounding the ear 48. Accordingly, it is preferable that the opening 60 and head engagement member 62 are large enough to entirely cover or encompass the ear 48.

Although not illustrated, it should be appreciated that the ear sound deliverer 20 can include a suitable cover (not shown) which extends across the opening 60. This cover can include a plurality of walls which define a plurality of openings or orifices. Such a cover can function as a cushioning or comfort member for the user's ear 48 or head portion 64. This cover can also function as a sound filter and/or a debris filter.

IV. Head Securing Member

As best illustrated in FIGS. 2 through 4, the head securing member 22 is preferably an elongated member which includes: (a) a sound director engagement member or end 65 which is attachable to the fastener or mount area 50 or 52; (b) an elongated engagement member 66 which preferably engages the back of the user's head area or neck area 67; and (c) a head portion engagement member 69 which engages a portion 71 of the user's head 24.

In one embodiment, the head securing member 22 has a spring or biasing property which biases the reverb device 10 against the head 24 of the user 12. In another embodiment, the head securing member 22 is partially rigid yet deformable so that the user 12 can reshape the head securing member 22 to the particular shape of the user's head 24. In such embodiment, the head securing member 22 can include an inner guide wire surrounded by an outer, relatively soft layer of material, such as a suitable rubber, foam or fabric. The inner guide wire provides rigidity to the head securing member 22.

The head portion engagement member 69 preferably defines a force distribution surface area. This surface area distributes the biasing force of the head securing member 22 over the user's head portion 71 so as to reduce or eliminate discomfort from the biasing force of the head securing member 22. In addition, the head portion engagement member 69 can include a friction increasing property or member which increases the friction between the user's head portion 71 and the head portion engagement member 69. The increase in friction can facilitate the attachment of the head securing member 22 to the head 24 of the user 12.

The head securing member 22 illustrated in FIGS. 1 through 5 is one example of one embodiment of the head securing member 22 of the present invention. It should be appreciated that in other embodiments not illustrated, the head securing member 22 can include any suitable strap, belt, band, harness or fastener which enables the reverb device 10 to be removably secured or attached to the head 24 of the user 12.

V. Sound Regulator

Figure 7:
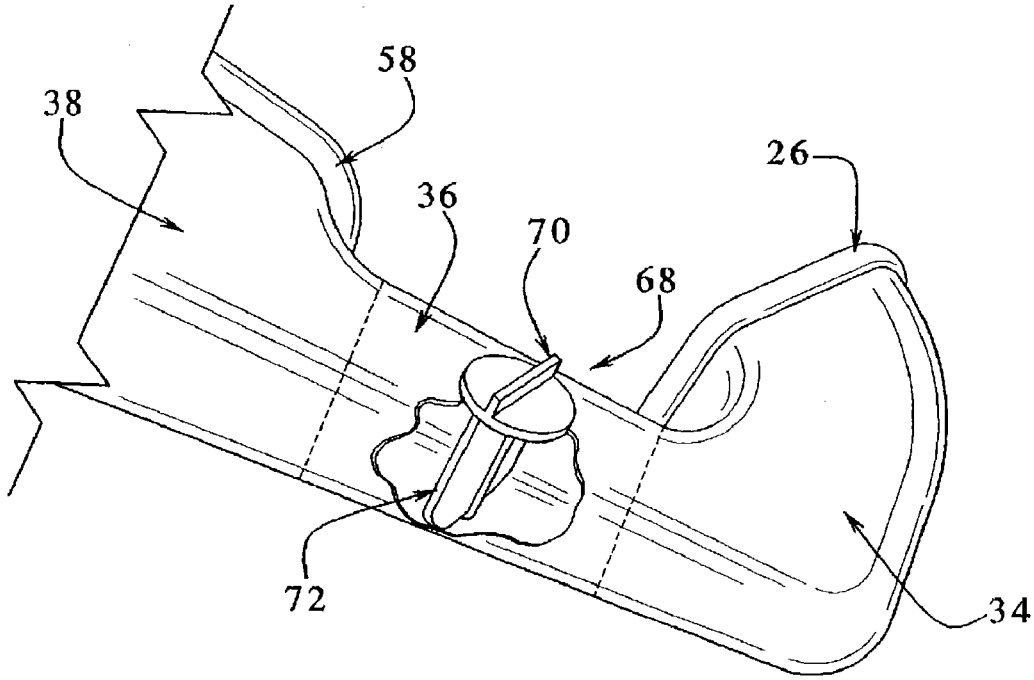
FIG. 7 is an elevated side perspective view of a portion of the reverb device including a break-away view of the sound regulator in one embodiment of the present invention.

Referring to FIG. 7, in one embodiment the reverb device 101 includes one or more sound flow regulators, such as sound regulator 68. The sound regulator 68 enables a user to regulate or alter the volume, flow or other characteristics of the vocal sounds 16 which enter the vocal sound receiver 14. In the embodiment illustrated in FIG. 7, the sound regulator 68 is connected to (and partially housed within) the intermediate tubular portion 36. However, it should be appreciated that in other embodiments the sound regulator 68 can be included within, housed within or otherwise connected to the curved tubular portion 34 or the curved tubular portion 38.

The sound regulator 68, in one embodiment, functions as a dialed damper to control sound volume. Here, the sound regulator 68 includes a control dial 70 connected to a sound barrier or damper 72. The damper 72 is preferably a substantially flat member. By turning or rotating the control dial 70, the user 12 can obstruct different levels of the vocal sound 16 which enter the vocal sound receiver 14. In the example illustrated in FIG. 7, the sound regulator 68 has a minimum sound position which significantly reduces the transmission of the vocal sound 16 to the ear 48. It should be appreciated that the sound regulator 68 can include any suitable device or mechanism for regulating the flow of sound, including but not limited to, suitable fluid control valves.

VI. Length Adjuster

Figure 8:
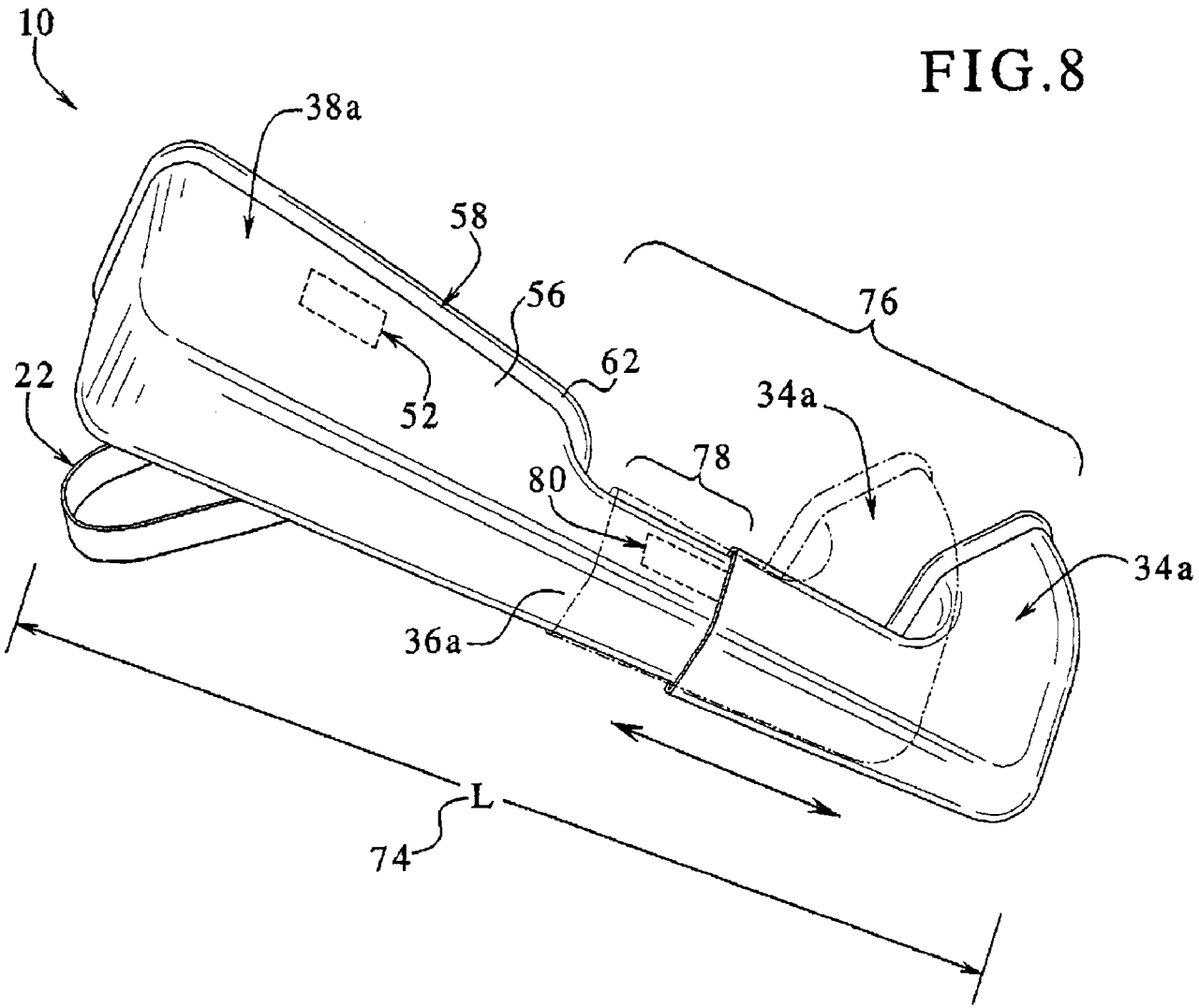
FIG. 8 is a top perspective view of the reverb device illustrating the length adjustment assembly in one embodiment of the present invention.

In one embodiment illustrated in FIG. 8, the reverb device 10 includes a length adjuster which enables the user 12 to adjust the overall length (L) 74 of the reverb device 10. Accordingly, the reverb device 10 is preferably adjustable for users of different sizes and ages. In the example illustrated in FIG. 8, the length adjuster includes a length adjustment assembly 76 which includes: (a) the curved tubular portion 34*a* having an inner diameter greater than the intermediate tubular portion 36*a* so that the curved tubular portion 34*a* slidably receives the intermediate tubular portion 36*a*; (b) a length adjustment zone 78 on the intermediate tubular portion 36*a*; and (c) an adjustment setter or length adjustment control member 80 which enables the user to adjustably set the position of the curved tubular portion 34*a* relative to the intermediate tubular portion 36*a*.

The adjustment control member 80 can include a releasable or adjustable fastener, a set of mating members, such as one or more teeth and an index, or any other device or mechanism which enables the user to adjust and set the overall length (L) 74 by adjusting the positions of the tubular portions 34*a* and 36*a* relative to one another. It should be appreciated that, in other embodiments, the intermediate tubular portion 36*a* can be sized to slidably receive the curved tubular portion 34*a*. Generally, the length adjuster of the present invention can include any suitable assembly having a slidable, rotatable or other type of movable engagement between the intermediate tubular portion 36 and the curved tubular portion 34 and/or the curved tubular portion 38.

VII. Materials and Construction

The reverb device 10 of the present invention can be instructed of any suitable material or materials. The reverb device 10 is preferably constructed of a relatively lightweight material. In one embodiment, the vocal sound receiver 14, sound director 18 and ear sound deliverer 20 are constructed of a suitable polymer, such as a plastic, and the construction method can be a suitable molding process resulting in a one-piece mold. In addition, any of the materials used to construct the reverb device 10 can have suitable fluorescent, transparent or translucent properties for the purposes described below.

VIII. Graphics

The reverb device 10 of the present invention can include different graphics, symbols or identifiers which identify or classify the various purposes, versions or types of reverb devices. For example, different colors or symbols can be displayed on the reverb device 10 to indicate the different versions of the reverb device 10 which are adapted for children, youth and adults. In another example, those reverb devices 10 which do not include sound regulators 68 can have a blue color, and those reverb devices 10 which do include sound regulators 68 can have a gray or black color. The blue color scheme can be used to designate reverb devices 10 which are adapted for recreational, entertainment or amateur use, and the gray or black color scheme can be used to designate reverb devices which are adapted for use by professionals or student vocalists for training purposes.

In addition, the reverb device 10 can include any suitable graphics or labeling on the exterior surface of the reverb device 10 to provide entertainment to users. For example, the reverb device 10 can include fluorescent labels enabling the reverb devices 10 to be visible in the dark. Also, as described above, the materials of the reverb device 10 can have fluorescent, transparent or translucent properties for entertainment purposes.

VIV. Method

In operation of one embodiment of the present invention: (a) the user 12 grasps the sound director 18; (b) the user 12 attaches the head securing member 22 to his/her head 24; (c) the user 12 preferably adjusts the head securing member 22 to the particular shape of the user's head 24; (d) the user 12 sings, speaks, hums or directs any other vocal sound into the vocal sound receiver; 14; (e) the sound receiver 14 receives the vocal sound; (f) the sound director 18 directs the vocal sound to the ear sound deliverer 20; and (g) the ear sound deliverer 20 outputs the vocal sound to the ear 48 of the user 12. Depending upon the particular embodiment, the user 12 may regulate the sound by adjusting the sound regulator 68, and the user 12 may adjust the length of the reverb device 10 by adjusting the length adjustment control member 80.

In the examples of the embodiments illustrated in FIGS. 1 through 8, the reverb device 10 has a substantially square or rectangular tubular shape. It should be appreciated that in other embodiments not illustrated, the tubular shape of the reverb device 10, or any portion thereof, can have any suitable geometry. For example, the sound director 18 can have a cylindrical shape or a conical shape.

The reverb device of the present invention, in one embodiment, includes a relatively light weight mechanical device which receives vocal sounds from the user and channels those vocal sounds to the user's ear. The reverb device of the present invention is preferably usable by the user in a hands-free fashion. Such a device assists users in hearing their own voices and generally provides training, enjoyment and entertainment for users.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A device for use in conjunction with a mouth and an ear of a user, the device comprising:

a vocal sound receiver configured to receive a sound from the user, the sound having a sound level;

a sound director having a first end, a second end, and at least one hollow portion positioned between the first end and the second end, the first end being coupled to the vocal sound receiver;

a sound regulator operatively coupled to the vocal sound receiver, the sound regulator configured to change the sound level to a different sound level; and an ear sound deliverer coupled to the second end of the sound director, the ear sound deliverer configured to:

(a) cover all of the ear of the user; and (b) deliver the different sound level to the ear of the user.

2. The device of claim 1, wherein the vocal sound receiver, the sound director and the ear sound deliverer are each entirely mechanical.

3. The device of claim 1, wherein the ear sound deliverer includes a head engagement member.

4. The device of claim 1, which includes at least one head securing member removably attached to the vocal sound receiver, the sound director or the ear sound deliverer.

5. The device of claim 1, which includes a length adjustment assembly defined by an operative coupling between the sound director and the: (a) vocal sound receiver; or (b) ear sound deliverer.

6. The device of claim 1, which includes a sound regulator operatively coupled to the vocal sound receiver, the sound director or the ear sound deliverer.

7. The device of claim 1, which includes a cover coupled to the vocal sound receiver, the cover having a plurality of walls which define a plurality of openings.

8. A device for directing sound from a mouth of a vocalist to an ear of the vocalist, the device comprising:

a vocal sound receiver defining at least one opening configured to receive a sound from the user, the sound having a sound level;

a sound regulator positioned adjacent to the vocal sound receiver, the sound regulator configured to change the sound level to a different sound level;

a sound director having: (a) a first hollow portion coupled to the vocal sound receiver, the first hollow portion defining at least one bend; (b) a second hollow portion coupled to the first hollow portion; and (c) a third hollow portion coupled to the second hollow portion, the third hollow portion defining at least one bend;

an ear sound deliverer coupled to the third hollow portion, the ear sound deliverer:

(a) defining at least one opening sized to cover all of the ear of the user, the ear sound deliverer having a head engagement member;

(b) having at least one head securing member coupled to the sound director; and (c) being configured to deliver the different sound level to the ear of the user.

9. The device of claim 8, wherein the sound director is a one-piece member.

10. The device of claim 8, wherein the vocal sound receiver, the sound director and the ear sound deliverer are each entirely mechanical.

11. The device of claim 8, wherein the head engagement member has a perimeter portion which encompasses the ear of the vocalist.

12. The device of claim 8, wherein the head securing member includes an elongated head portion engagement member.

13. The device of claim 8, wherein the sound director includes a fastener which enables the head securing member to be removably attached to the sound director.

14. The device of claim 8, wherein the device has an interchangeable left ear orientation and right ear orientation.

15. The device of claim 14, wherein the sound director includes: (a) a first fastener which enables the head securing member to be removably attached to a first side of the sound director in the left ear orientation; and (b) a second fastener which enables the head securing member to be removably attached to a second side of the sound director in the right ear orientation.

16. The device of claim 8, wherein the vocal sound receiver includes a cover which extends across the opening of the vocal sound receiver.

17. The device of claim 16, wherein the cover has a plurality of walls which define a plurality of openings.

18. The device of claim 16, wherein the cover has a porous structure.

19. The device of claim 8, wherein the sound director includes a length adjuster which enables a distance between the vocal sound receiver and the ear sound deliverer to be adjusted.

20. The device of claim 19, wherein the second tubular portion has a length adjustment zone.

21. The device of claim 20, wherein the first tubular portion has a size relative to a size of the second tubular portion so that the first tubular portion slidably receives the second tubular portion.

22. The device of claim 20, wherein the first tubular portion has a size relative to a size of the second tubular portion so that the first tubular portion is slidably received by the second tubular portion.

23. The device of claim 20, wherein the first tubular portion or the second tubular portion includes a length adjustment control member.

24. The device of claim 8, wherein the vocal sound receiver, the sound director or the ear sound deliverer includes at least one sound regulator.

25. The device of claim 24, wherein the sound regulator has a plurality of settings for controlling different levels of transmission of the sound to the ear sound deliverer.

26. A method for configuring a device for directing vocal sound from a vocalist to at least one ear of the vocalist, the method comprising:

(a) configuring the device so as to enable the vocalist to secure- the device to a head portion of the vocalist;

(b) configuring- a first portion of the device so that the first portion is operable to receive the vocal sound from the vocalist, the vocal sound having a sound level;

(c) configuring the device to enable the sound level to be changed to a different sound level;

(d) configuring- a second portion of the device so that the second portion is operable to direct at least a portion of the different sound level towards a third portion of the device, wherein the second portion has a hollow shape; and (e) configuring the third portion of the device so that the third portion is operable to: (i) cover all of the ear; and (ii) direct the at least portion of the different sound level to the ear of the vocalist.

27. The method of claim 26, wherein step (a) includes the step of providing a unitary device which includes the first portion, the second portion and the third portion.

28. The method of claim 26, which includes the step of enabling the vocalist to adjust a length of the device.

29. The method of claim 26, which includes the step of enabling the vocalist to adapt the device for delivering the vocal sound to a right ear or a left ear of the user.

30. The method of claim 26, which includes the step of enabling the vocalist to regulate a characteristic of the vocal sound which is transmitted from the first portion of the device to the third portion of the device.

31. A method for configuring a device for assisting a user in hearing a voice of the user, the method comprising:

(a) configuring a mechanical head set so as to enable the user to install the mechanical head set on a head portion of the user;

(b) configuring the mechanical head set so as to enable the user to input a vocal sound into the mechanical head set, the vocal sound having a sound level;

(c) configuring the mechanical head set to include a receiving portion of which is operable to receive the vocal sound;

(d) configuring the mechanical head set to include a sound regulator positioned adjacent to the receiving portion, wherein the sound regulator is operable to change the vocal sound level to a different sound level;

(e) configuring the mechanical head set so that the mechanical head set is operable to direct at least a portion of the different sound level from the receiving portion, through a hollow channel toward at least one ear of the user, wherein the ear has a perimeter and the perimeter defines a total area of the ear; and (f) configuring the mechanical head set so that the mechanical head set is operable to direct the at least portion of the different sound level to the total area of the ear.

32. The method of claim 31, wherein step (a) includes the step of providing a unitary mechanical head set.

33. The method of claim 31, which includes the step of enabling the user to adjust a length of the mechanical head set.

34. The method of claim 31, which includes the step of enabling the user to adapt the mechanical head set for delivering the vocal sound to a right ear or a left ear of the user.

35. The method of claim 31, which includes the step of enabling the user to regulate a characteristic of the vocal sound which is directed to an ear of the user.

* * * * *